US010986877B2

(12) United States Patent
Kimel et al.

(10) Patent No.: US 10,986,877 B2
(45) Date of Patent: Apr. 27, 2021

(54) LOWER TORSO GARMENT WITH SUPPORT ELEMENT

(71) Applicant: HBI BRANDED APPAREL ENTERPRISES, LLC, Winston-Salem, NC (US)

(72) Inventors: Sherry E. Kimel, King, NC (US); Tasha R. Perry, Winston Salem, NC (US); Rachel I. Erickson, Winston Salem, NC (US); Melissa A. Coleman, Kernersville, NC (US)

(73) Assignee: HBI Branded Apparel Enterprises, LLC, Winston Salem (NC)

( * ) Notice: Subject to any disclaimer, the term of this patent is extended or adjusted under 35 U.S.C. 154(b) by 0 days.

(21) Appl. No.: 16/090,539

(22) PCT Filed: Apr. 13, 2017

(86) PCT No.: PCT/US2017/027496

§ 371 (c)(1),
(2) Date: Oct. 1, 2018

(87) PCT Pub. No.: WO2017/180920

PCT Pub. Date: Oct. 19, 2017

(65) Prior Publication Data

US 2019/0116889 A1 Apr. 25, 2019

Related U.S. Application Data

(60) Provisional application No. 62/322,779, filed on Apr. 14, 2016.

(51) Int. Cl.

| | |
|---|---|
| ***A41B 9/02*** | (2006.01) |
| *A41B 9/12* | (2006.01) |
| *A41B 9/00* | (2006.01) |

(52) U.S. Cl.
CPC ..... *A41B 9/023* (2013.01); *A41B 9/026* (2013.01); *A41B 9/001* (2013.01); *A41B 9/004* (2013.01);
(Continued)

(58) Field of Classification Search
CPC ..... A41B 9/023; A41B 9/026; A41B 9/12; A41B 9/02; A41B 9/001; A41B 9/004;
(Continued)

(56) References Cited

U.S. PATENT DOCUMENTS 1,083,712 A * 1/1914 Uyeda ..... A41B 9/04 2/408
1,206,979 A * 12/1916 Belton ..... A41B 9/02 2/404
(Continued)

FOREIGN PATENT DOCUMENTS

JP S57188804 11/1982
JP H0315521 Y2 4/1991
(Continued)

OTHER PUBLICATIONS

PCT International Search Report and Written Opinion in International Application No. PCT/US2017/027496, dated Apr. 13, 2017, 4 pages.
(Continued)

*Primary Examiner* — Khaled Annis
*Assistant Examiner* — Dakota Marin
(74) *Attorney, Agent, or Firm* — Fish & Richardson P.C.

(57) ABSTRACT

A lower torso garment (220) includes a body portion (104), a front pouch (106) disposed about a front region of the body portion, and a support sling connected to the front pouch and configured to support the front pouch. The support sling includes a left fabric panel (224) extending along a left side periphery (112*a*) of the front pouch and a right fabric panel
(Continued)

(226) extending along a right side periphery (112*b*) of the front pouch. A portion of the left fabric panel overlaps a portion of the right fabric panel at an overlap area (228), and the overlap area is positioned adjacent to a bottom of the front pouch.

20 Claims, 2 Drawing Sheets

(52) U.S. Cl.
CPC ..... *A41B 9/005* (2013.01); *A41B 9/02* (2013.01); *A41B 9/12* (2013.01); *A41B 2300/22* (2013.01); *A41B 2300/35* (2013.01); *A41B 2400/38* (2013.01); *A41B 2500/10* (2013.01)

(58) Field of Classification Search
CPC . A41B 9/005; A41B 2300/35; A41B 2300/22; A41B 2400/38; A41B 2500/10
USPC ..... 2/404, 403
See application file for complete search history.

(56) References Cited

U.S. PATENT DOCUMENTS

| | | | | | |
|---|---|---|---|---|---|
| 1,254,463 | A * | 1/1918 | Arrington, Jr. | A41B 9/02 | 602/67 |
| 2,022,751 | A * | 12/1935 | Waksmundzka | A41B 9/02 | 450/104 |
| 2,214,578 | A * | 9/1940 | Davis | A41B 9/02 | 2/403 |
| 2,243,643 | A * | 5/1941 | Murphey | A41B 9/02 | 2/403 |
| 2,349,426 | A * | 5/1944 | Harwood | A41B 9/02 | 2/403 |
| 2,356,696 | A * | 8/1944 | Reis | A41B 9/02 | 2/404 |
| 2,416,108 | A * | 2/1947 | Lloyd | A41B 9/02 | 2/405 |
| 2,431,571 | A * | 11/1947 | Lehr | A41B 9/02 | 2/402 |
| 2,549,374 | A * | 4/1951 | Friedman | A41B 9/02 | 2/403 |
| 2,553,353 | A * | 5/1951 | Binder | A61F 5/03 | 602/67 |
| 2,822,807 | A * | 2/1958 | Heyman | A61F 5/4401 | 602/67 |
| 3,038,471 | A * | 6/1962 | Van Horne | A41B 9/02 | 602/67 |
| 3,166,764 | A * | 1/1965 | Stedman | A41B 9/02 | 2/403 |
| 3,524,449 | A * | 8/1970 | Peters | A41C 1/00 | 450/100 |
| 4,377,008 | A * | 3/1983 | Jung | A41B 9/023 | 2/403 |
| 6,425,140 | B1 * | 7/2002 | Vitches | A41B 9/02 | 2/400 |
| 7,434,273 | B2 * | 10/2008 | Chung | A41B 9/023 | 2/403 |
| 7,958,571 | B2 * | 6/2011 | Kitsch | A41B 9/023 | 2/403 |
| 9,375,035 | B1 * | 6/2016 | Ingels | A41B 9/02 | |
| 10,085,491 | B2 * | 10/2018 | Howard | A41B 9/026 | |
| 2004/0016043 | A1 * | 1/2004 | Uno | A41B 9/001 | 2/400 |
| 2007/0220661 | A1 * | 9/2007 | Blohmann | A41B 9/023 | 2/404 |
| 2012/0060264 | A1 * | 3/2012 | Wilkins | A41B 9/04 | 2/406 |
| 2012/0260404 | A1 | 10/2012 | Steele | | |
| 2014/0047620 | A1 * | 2/2014 | Ingalls | A41B 9/02 | 2/403 |
| 2015/0181946 | A1 | 7/2015 | Donmoyer | | |
| 2015/0223524 | A1 * | 8/2015 | Brady | A41D 13/0015 | 2/401 |
| 2015/0320118 | A1 | 11/2015 | Frantz et al. | | |

FOREIGN PATENT DOCUMENTS

| | | | |
|---|---|---|---|
| JP | 2005264414 | A | 9/2005 |
| JP | 317596 | A | 5/2019 |
| KR | 101005008 | | 1/2011 |
| KR | 20110029488 | | 3/2011 |
| WO | WO2014027731 | | 2/2014 |
| WO | WO2015111830 | | 7/2015 |

OTHER PUBLICATIONS

PCT International Search Report and Written Opinion in International Application No. PCT/US2017/027500, dated Apr. 13, 2017, 13 pages.
Chinese Office Action in CN Application No. 201780023376, dated Apr. 10, 2020, 20 pages with English Translation.
Chinese Office Action in CN Application No. 201780023376, dated Dec. 28, 2020, 14 pages with English Machine Translation.

* cited by examiner

LOWER TORSO GARMENT WITH SUPPORT ELEMENT

CROSS-REFERENCE TO RELATED APPLICATION(S)

This application is a U.S. National Phase Application under 35 U.S.C. § 371 and claims the benefit of priority to International Application Serial No. PCT/US2017/027496, filed Apr. 13, 2017, which claims priority to U.S. Provisional Application Ser. No. 62/322,779, filed Apr. 14, 2016, the contents of which are hereby incorporated by reference.

TECHNICAL FIELD

This disclosure relates to lower torso garments having support elements, such as men's underwear.

SUMMARY

This disclosure describes lower torso garments, such as men's undergarments, with support elements.

In some aspects, a lower torso garment includes a body portion, a front pouch disposed about a front region of the body portion, and a support element connected to the front pouch. In certain aspects, a lower torso garment comprises a body portion, a front pouch disposed about a front region of the body portion, and a support element connected to the front pouch and configured to support the front pouch.

These aspects can include some, none, or all of the following features. The support element can include a support sling disposed in part about a periphery of the front pouch. The support element can include a criss-cross support sling proximate lateral sides of the front pouch. The support element can include a keyhole support sling proximate lateral sides of the front pouch. The support element can include a support basket proximate a bottom area of the front pouch. The support element can include a seam extending laterally across the front region, the seam configured to provide support to the front pouch. The seam can include elastic portions. The seam can create fabric gathers in the front pouch proximate the seam. The lower torso garment can include a waistband. The lower torso garment can include a gusset between two leg portions. The support element can include a flexible mesh fabric.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

This disclosure describes support elements for lower torso garments, for example men's underwear (e.g., boxers, boxer-briefs, briefs, and/or others). Support elements can take a variety of forms, for example, depending on the intended location of support, lower torso garment type, function, flexibility, and/or other factors. Support elements described herein can be used to support at least a portion of the external male genitalia of a wearer of the lower torso garment, where the wearer's external male genitalia is disposed proximate a front pouch region of the lower torso garment. The front pouch region can include a variety of support elements that can provide support for all or a portion of the external male genitalia. For example, the lower torso garment can include a support sling surrounding (partially, substantially, or completely) the front pouch, such as about a periphery of the front pouch. The support sling can include support panels, such as web-like mesh fabric layers, shaped to define, in part, a partially enclosed sling region for at least a portion of the external male genitalia of a wearer to be disposed, where the sling region can include an area between an interior surface of the front pouch and the support panels of the support sling. In some instances, the support elements can include a stitch line or a stitch seam across or along a lower portion of the front pouch of the lower torso garment to provide stretchability, support, or both stretchability and support to the front pouch supporting the male anatomy of a wearer.

Figure 1:
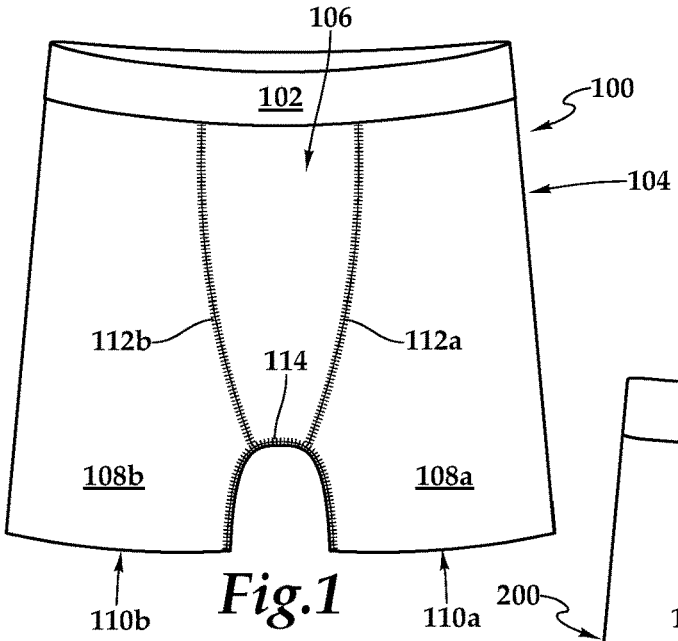
FIG. 1 is a front view of an example lower torso garment.

FIG. 1 is a front view of an example lower torso garment 100, for example, a men's boxer brief. The lower torso garment includes a waistband 102 at an upper end of the lower torso garment 100, and a body region 104 including a front pouch 106, a rear buttocks area (not shown), and a left leg region 108*a* and a right leg region 108*b*, each with respective leg openings 110*a* and 110*b* at lower ends of the respective left leg region 108*a* and right leg region 108*b*. The waistband 102 has a torso-encircling shape, and connects to the body region 104, for example, via seamless knitting, stitching, fusing, bonding, adhering, or other connections. With a wearer wearing the example lower torso garment 100, the waistband encircles a torso of the wearer, the front pouch 106 resides adjacent to and supporting at least a portion of the external male genitalia of the wearer, the buttocks region resides adjacent to the buttocks of a wearer, and the left and right leg regions 108*a* and 108*b* receive the legs of the wearer. The front pouch 106 is shown in FIG. 1 as stitched to adjacent fabric of the body region 104 at lateral seams, for example, a left pouch seam 112*a* and a right pouch seam 112*b*; however, the front pouch 106 can connect to adjacent fabric of the body region 104 in a variety of other ways. For example, the front pouch 106 can connect to the adjacent fabric of the body region 104 by knitting (e.g., seamless knitting), stitching, fusing, bonding, adhering, or other connections.

In some implementations, the front pouch 106 of the lower torso garment 100 includes a support element or multiple support elements to provide support, reinforcement, and/or comfort to the front pouch 106 and/or to a wearer of the lower torso garment 100. In certain instances, the support element includes a flexible fabric, such as a flexible mesh fabric. However, the material of the support element can vary, and can be more flexible, less flexible, or the same flexibility as the fabric of the front pouch 106 and/or body region 104. In some examples, the support element of the front pouch 106 includes a support sling disposed at an interior of the garment. The support sling can take a variety of forms, as described in more detail below. In some instances, the body region 104 includes a gusset portion at a bottom of the lower torso garment 100 between the leg regions 108*a* and 108*b*. The lower torso garment 100 can be manufactured in a variety of ways, such as circularly knitting all or most of the lower torso garment 100, cutting fabric to form portions of the lower torso garment 100, and/or stitching together the cut portions of the lower torso garment 100 at stitches or seams joining the garment portions, such as at areas indicated in the drawings. The front pouch 106 can be knit to the body region 104, shown in FIG. 1 as knit at the left and right lateral seams 112*a* and 112*b* about the front portion and a bottom horizontal seam 114 proximate the gusset. In some examples, such as shown in FIGS. 4, 5A, and 5B and described in more detail later, the front pouch can include a pass-through fly opening including an overlap, for example, for through-access of all or a portion of the external male genitalia to be exposed exterior to the garment through the pass-through when the garment is worn by the wearer.

Figure 2A:
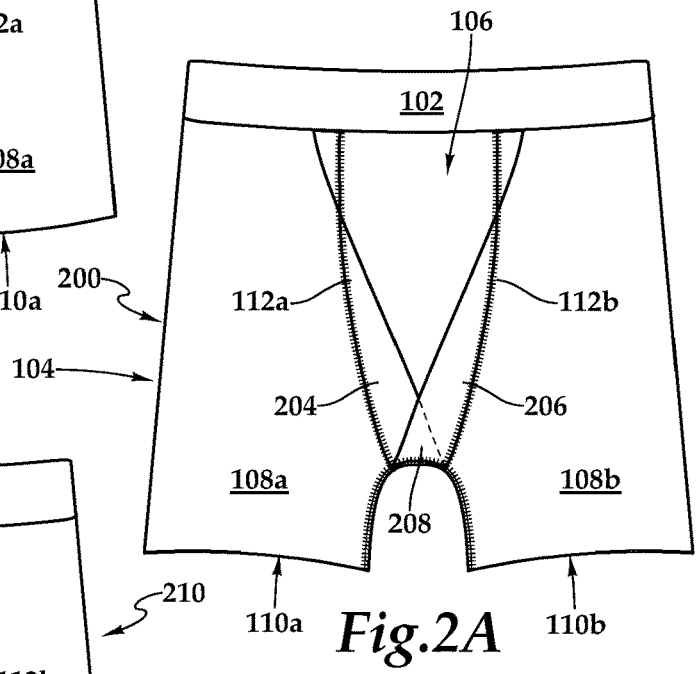
FIGS. 2A-2C are cross-sectional interior front views of example lower torso garments with support structures.

FIG. 2A is a cross-sectional interior front view of an example lower torso garment 200 showing the interior of the front of the lower torso garment 200, for example, the portions of the interior front of the lower torso garment 200 that engage the skin of a wearer of the lower torso garment 200. Example lower torso garment 200 is like the lower torso garment 100 of FIG. 1, except the example lower torso garment 200 includes a support element in the form of a support sling 202 disposed within the body region 104 (i.e., at an interior of the garment) proximate the front pouch 106 and along the left and right lateral seams 112*a* and 112*b* that substantially define the lateral periphery of the front pouch 106. The support sling 202 includes a left fabric panel 204 and a right fabric panel 206 extending from a bottom edge of the front pouch 106 to a top edge of the front pouch adjacent the waistband 102.

Referring to the example lower torso garment of FIG. 2A, the left fabric panel 204 and the right fabric panel 206 of the support sling 202 are disposed in a criss-cross pattern and reside on either side of the front pouch 106 proximate one of the substantially vertical seams 112*a* and 112*b* on the lateral sides of the front pouch 106. The left fabric panel 204 and the right fabric panel 206 can each include a web of fabric that attaches to a periphery of the front pouch 106 and extends between a top and a bottom of the front pouch 106. The left fabric panel 204 and the right fabric panel 206 overlay at least a portion of the fabric of the front pouch 106, for example, to create a pocket for the external male genitalia of the wearer, where all or at least a portion of the external male genitalia of the wearer resides and is supported within the pocket between the fabric of the front pouch 106 and the left and right fabric panels 204 and 206. In some examples, the left fabric panel 204 and the right fabric panel reside between at least a portion of the external male genitalia of the wearer and the inner thigh of the wearer to act as a fabric barrier between skin contact of the inner thigh and the external male genitalia of the wearer. As shown in FIG. 2A, the left fabric panel 204 and the right fabric panel 206 are substantially symmetrical across a vertical centerline of the garment, for example, across a centerline of the front pouch 106. A long-edge of each fabric panel attaches along its edge length to the left or right lateral seam (112*a* or 112*b*, respectively) of the front pouch 106, and a first short edge at one end of each fabric panel attaches proximate the waistband 102 and a second short edge at its other end (e.g., opposite the first short edge) is attached at a bottom of the front pouch 106 (e.g., at the gusset). Each of the fabric panels criss-cross, or twist, between its connection proximate the waistband 102 and its connection at the bottom of the front pouch 106. For example, the left fabric panel 204 criss-crosses along its longitudinal length as it extends from the top of the front pouch 106 to the bottom of the front pouch 106. Similarly, the right fabric panel 206 criss-crosses along its longitudinal length as it extends from the top of the front pouch 106 to the bottom of the front pouch 106. At the one end proximate the waistband 102, the first short edge of the fabric panel (e.g., left fabric panel 204 or right fabric panel 206) extends substantially outwardly (e.g., toward a wearer's side) along the waistband 102, while the second short edge extends substantially inwardly, opposite the direction of first short edge. As shown in FIG. 2A, the left fabric panel 204 and the right fabric panel 206 overlap at an overlap area 208 near a bottom of the front pouch 106, where the overlapped edge of the left fabric panel 204 is indicated in a dashed line. The widths of the left fabric panel 204 and the right fabric panel 206 can partially or completely overlap at its lower attachment to the bottom of the front panel 106. As the left fabric panel 204 and right fabric panel 206 extend upwards toward the waistband, the overlap area 208 decreases until the fabric panels no longer overlap, creating a substantially triangular area of the overlap area 208.

The left fabric panel 204 and the right fabric panel 206 can include a plurality of materials and fabrics. For example, the fabric panels can include a flexible fabric, such as a flexible mesh fabric, a fabric web, taping, or other material. The material of the support element can vary, and can be more flexible, less flexible, or the same flexibility as the fabric of the front pouch and/or body region. In some instances, the fabric of the body portion 104 can include cotton, spandex, a combination of these, and/or other material, the front pouch fabric can include cotton, spandex, a combination of these, and/or other material, the thread (e.g., the seams) can include polyester, cotton, and/or other material, the waistband 102 can include polyester, spandex, and/or other material, and the support sling (e.g., support sling 202) can include polyester, spandex, and/or other material. For example, the fabric panels of the support sling can include a knitted synthetic mesh fabric, such as knitted polyester fiber, a lightweight jersey (e.g., cotton) fabric, can include ventilation openings, and can include spandex or other elastomeric material. The left and right fabric panels can have zero stretch or some degree of stretch (e.g., up to 10%, 20%, 30%, 50%, or more stretch), and the stretch can include a material stretch or a mechanical stretch (e.g., cotton ribs).

In some instances, the support sling (e.g., criss cross support sling 202) is integrated into the make or construction of the lower torso garment (e.g., boxer brief, or lower torso garment 200) to provide enhanced support as a result of adding the criss-crossed support sling 202 proximate the area of the front pouch 106. By adding the inner sling to the inside of lower torso garment at the front pouch and criss crossing the sling layers (e.g., fabric panels, or webs) at a bottom portion of pouch, the wearer noticeably feels more support, for example, than when wearing a lower torso garment without a sling in the pouch. The sling can be accomplished by using two panels of light weight stretch fabric criss crossed at bottom portion of pouch inside the garment. In some implementations, the criss cross support sling can be added to the pattern for garment make-up and stitched into the seams during construction.

Figure 2B:
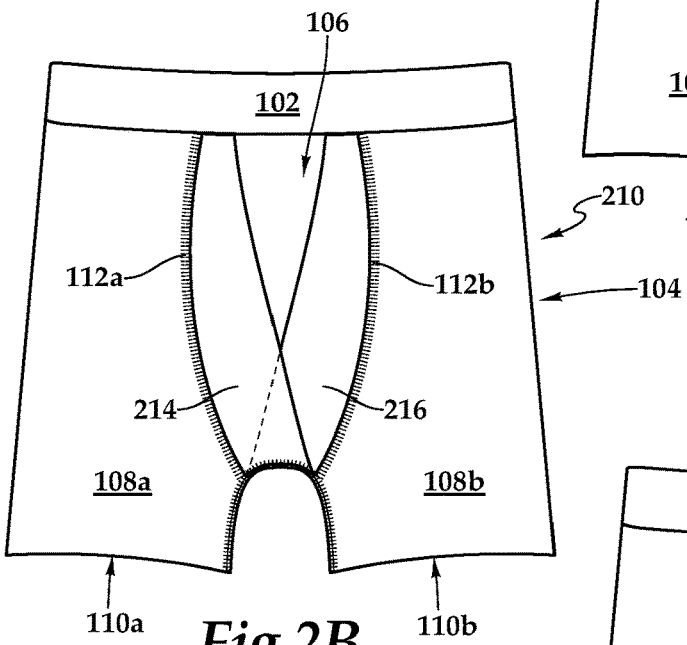

The shape and placement of the support sling can vary. For example, FIG. 2B is a cross-sectional interior front view of an example lower torso garment 210 with a support sling 212, where FIG. 2B shows the interior of the front of the lower torso garment 210. The example lower torso garment 210 and support sling 212 are like the example lower torso garment 200 and support sling 202 of FIG. 2A, except the support sling 212 of lower torso garment 210 includes a substantially planar left fabric panel 214 and right fabric panel 216, where the left fabric panel 214 and right fabric panel 216 do not include a criss-cross, or twist, as the panels extend vertically along the front pouch 106. Instead, a periphery of the support sling 212 remains within the periphery of the front pouch 106. The left fabric panel 214 and the right fabric panel 216 include the overlap area 208 near a bottom of the front pouch 106, where the overlapped edge of the right fabric panel 216 is shown in a dashed line. A laterally outside edge of the left fabric panel 214 connects to and extends along the left lateral seam 112*a*, and a laterally outside edge of the right fabric panel 216 connects to and extends along the right lateral seam 112*b*. Top edges of the left fabric panel 214 and right fabric panel 216 extend laterally inwardly towards each other, leaving a gap between the top edges and the inner edges of the fabric panels that define an opening, for example, for a portion of the external the male genitalia to pass through when a wearer wears the lower torso garment 210.

Figure 2C:
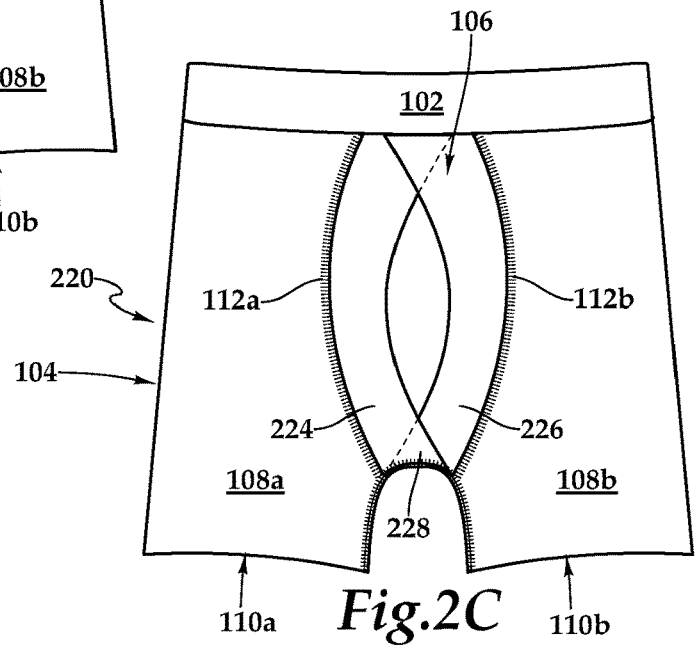

FIG. 2C is a cross-sectional interior front view of an example lower torso garment 220 with a support sling 222, where FIG. 2C shows the interior of the front of the lower torso garment 220. The example lower torso garment 220 and support sling 222 are like the example lower torso garments 200 and 210 and support slings 202 and 212 of FIGS. 2A and 2B, respectively, except the support sling 222 of lower torso garment 220 includes a substantially planar left fabric panel 224 and right fabric panel 226 that overlap each other at a first overlap area 228 at a bottom of the front pouch 106 and also overlap each other at a second overlap area 230 at a top of the front pouch 106. For example, a first portion of the left fabric panel 224 overlaps a first portion of the right fabric panel 226 to define the first overlap area 228, and a second portion of the left fabric panel 224 overlaps a second portion of the right fabric panel 226 to define the second overlap area 230. FIG. 2C shows the first overlap area 228 and second overlap area 230 as substantially the same size; however, the overlap area can be different. For example, the first overlap area 228 can be larger or smaller than indicated in FIG. 2C, and can be larger or smaller than the second overlap area 230. Similarly, the second overlap area 230 can be larger or smaller than indicated in FIG. 2C, and can be larger or smaller than the first overlap area 228.

In some instances, constructing the example lower torso garment (e.g., lower torso garment 200, 210, 220) includes determining the correct placement for the support sling (e.g., support sling 202, 212, 222) on the lower torso garment by fitting the lower torso garment on a fit model and analyzing original garment specs of the lower torso garment (e.g., boxer brief) in which the support sling is to be added. Once placement and pattern are determined, two panels of fabric can be added, one to each side of the pouch inside of garment (at seaming). In some examples, the support sling can be sewn into the garment using the correct stretch direction for the fabric used as the sling. Edges of the sling fabric panels can be edged using a purl stitch, an over edge stitch, a finished edge, a laser-cut edge, a finished seam, a folded seam, or other edge type.

Referring to the example lower torso garment 220 shown in FIG. 2C, the support sling 222 is a key-hole shaped support sling. The keyhole support sling 222 is disposed on an interior of the boxer-brief lower torso garment 220 and lines the periphery of the front pouch 106. The left fabric panel 224 and right fabric panel 226 of the support sling 222 at least partially overlap at the second overlap area 230 at an upper end of the front pouch 106 and at the first overlap area 228 at a lower end of the front pouch 106. A long-edge of each panel of the left fabric panel 224 and the right fabric panel 226 attaches along its edge length to the left or right lateral seam of the front pouch 106, and a first short edge at one end is attached proximate the waistband and the second short edge at its other end is attached at the bottom of the front pouch 106 (e.g., at the gusset). Both the short edges extend substantially inwardly, and can overlap at the upper seam and lower seam of the front pouch 106. The fabric panels create a keyhole-shaped opening between the two fabric panels. The fabric panels can include a plurality of materials and fabrics. In the example lower torso garment 220 of FIG. 2C, the fabric panels include a mesh fabric.

In some instances, the keyhole support sling can be constructed by adding to each side of the pouch inside of the lower torso garment (e.g., at the seaming) the two pieces of fabric that cross over one another at the top and bottom of pouch to create the key hole sling and support for the wearer. The keyhole support sling can be sewn into the garment using the correct stretch direction for the sling fabric. Edges of sling fabric panels can be edged using a purl over edge stitch for comfort.

The left fabric panel (204, 214, 224) and the right fabric panel (206, 216, 226) of the support sling (202, 212, 222) of the lower torso garments (200, 210, 220) of FIGS. 2A-2C can be disposed in a variety of locations and positions, and can include various materials and constructions. For example, the left and right fabric panels can include a single ply fabric panel or a multi-ply fabric panel (e.g., dual ply fabric panel), and the inner edges of the fabric panels can include a purl stitch, an over-edge stitch, a finished edge, a laser-cut edge, a finished seam, a folded seam, or other edge type.

The front pouch 206 can act as a basket sling that acts as a support basket for the external male genitalia of a wearer, and can provide for multi-directional support of the external male genitalia, for example, during movement and/or activity of the wearer.

Figure 3:
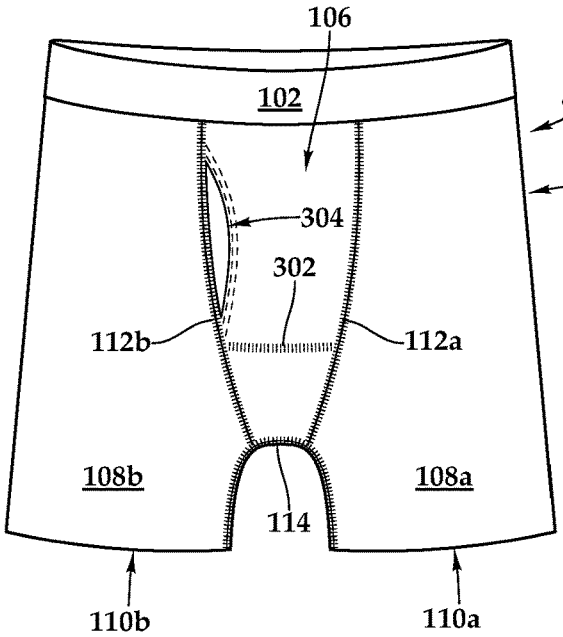
FIG. 3 is a front view of an example lower torso garment.

FIG. 3 is a front view of an example lower torso garment 300, similar to the lower torso garments 200, 210, 220 of FIGS. 2A-2C, except (at least) the front pouch includes a support element in the form of a support stitch line 302 extending horizontally (substantially or exactly) between the lateral side seams 112*a* and 112*b* at the periphery of the front pouch 106, and the lower torso garment 300 includes a pass-through fly opening 304 including an overlap, for example, for through-access of the external male genitalia to be exposed exterior to the garment through the pass-through when the garment is worn by the wearer. The example lower torso garment 300 of FIG. 3 does not include a support sling described earlier with respect to FIGS. 2A-2C; however, the example lower torso garment 300 can include one or more of the other support elements, support structures, and/or support slings described herein. In some instances, the lower torso garment 300 excludes the fly opening 304. The support stitch line 302 is illustrated as extending between the left and right lateral seam 112*a* and 112*b* of the front pouch 106 proximate a front-bottom area of the front pouch. The horizontal seam extends between the left and right front pouch seam to provide support for the crotch region of a wearer of the garment. The horizontal seam can include a cover stitch, over edge stitch, flatlock seam, or other type of stitch or seam. The SPI (stiches per inch) can vary. For example, the SPI can be about 13 (e.g., between 11 and 15), or different (e.g., between 5 and 20). The front pouch 106 can include two layers of fabric (e.g., two-ply fabric), and the horizontal seam can be sewn through both layers of the front pouch fabric.

The type and placement of the support stitch line 302 can vary. For example, FIG. 3 shows the support stitch line 302 as placed just below the fly opening 304 (e.g., within one or two inches of the fly opening edge), about two-thirds (⅔) down the longitudinal length of the front pouch 106 from the top of the front pouch 106, or one-third (⅓) up the longitudinal length of the front pouch 106 from the bottom of the front pouch 106. However, the location of the support stitch line 302 can vary, for example, the support stitch line 302 can be located vertically higher or lower than the position indicated in FIG. 3.

The support stitch line 302 can take a variety of forms. Although the support stitch line 302 is described herein in some instances as including a seam, the support stitch line 302 may not be a seam or a stitch. Instead, the support stitch line 302 can include a support element, such as a tape or other attachment that can fuse, bond, adhere, or otherwise attach to the front pouch 106 of the lower torso garment 300, between fabric layers of the front pouch 106, or otherwise connect to the front pouch. For example, the support stitch line 302 can include a stitch-sew line extending laterally across the front pouch 106, taping that is fused, adhered, or otherwise attached to the front pouch, other material that is fused or bonded to the fabric of the front pouch 106, sew thread that is knit, woven, stitched, or otherwise connected to the front pouch, and/or other materials. In some examples, the support stitch line 302 includes a width of up to an inch (e.g., ¼ inches, ½ inches, ¾ inches, or another width dimension). In some instances, the support stitch line 302 can provide some degree of stretch. In some examples, the support stitch line 302 has less stretch than the fabric of the front pouch 106, for example, to provide strength and/or support to the front pouch in addition to or in lieu of a gusset.

Figure 4A:
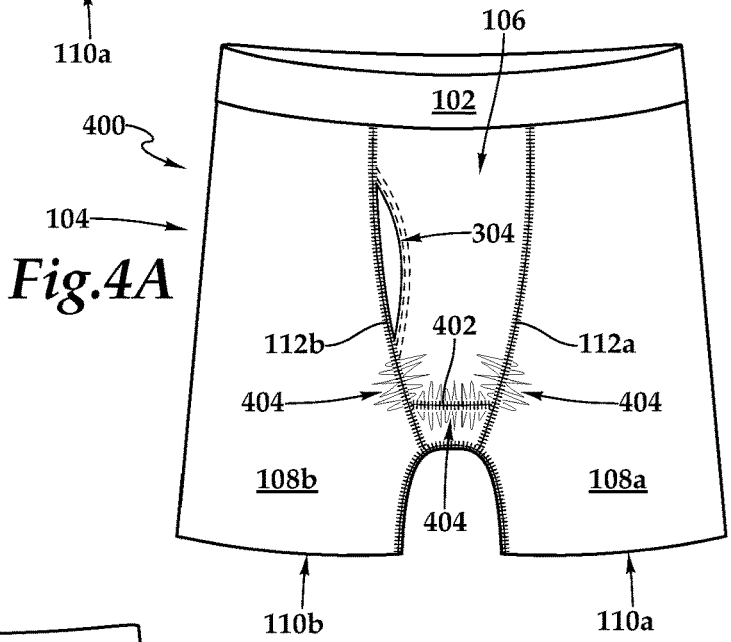
FIGS. 4A-4B are a front view and a cross-sectional interior front view of an example lower torso garment.
Figure 4B:
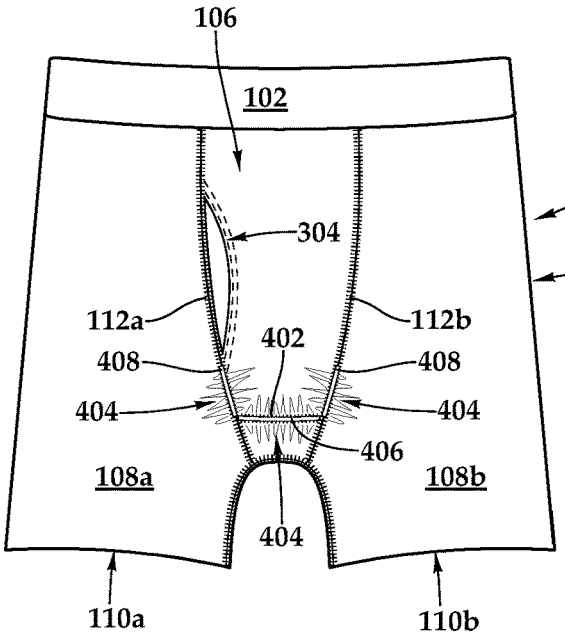

FIGS. 4A and 4B are a front view and a cross-sectional interior front view, respectively, of an example lower torso garment 400, similar to lower torso garment 300 of FIG. 3, where the example lower torso garment includes a support stitch line 402 extending horizontally (substantially or exactly) between the lateral side seams 112*a* and 112*b* at the periphery of the front pouch 106. FIG. 4B shows the interior of the front of the example lower torso garment 400. In some instances, such as shown in the example lower torso garment 400 of FIGS. 4A and 4B, the support stitch line 402 is a horizontal support seam that creates gathers 404 in the fabric about (e.g., surrounding) a support seam. In some instances, this support stitch line 402 includes one or more elastic elements 406 (e.g., elastomeric elements, or other elements effecting an elastic/elastomeric/stretch characteristic of the stitch) integrated into the support stitch line 402, for example, at an interior side of the front pouch 106. The elastic element(s) 406 biases the horizontal support stitch line 402 to compress edges of adjacent fabric edges to create the fabric gathers 404 (e.g., extra body fabric, fabric folds, fabric wrinkles, and/or other forms of gathers) in the fabric of the front pouch 106 surrounding the support stitch 402. The fabric gathers 404 allow a greater degree of stretch to the fabric of the front pouch 106 (e.g., than fabric without gathers), and allows space for the external male genitalia of a wearer of the lower torso garment 400. The support stitch line 402 can extend between a left and right seam of the front pouch 106 proximate a front-bottom area of the front pouch 106, and includes the elastic element 406.

The type and placement of the support stitch line 402 can vary. For example, FIGS. 4A and 4B show the support stitch line 402 as placed below the fly opening 304 (e.g., within one or two inches of the fly opening edge). However, the location of the support stitch line 402 can vary, for example, the support stitch line 402 can be located vertically higher or lower than the position indicated in FIGS. 4A and 4B.

The support stitch line 402 can take a variety of forms. Although the support stitch line 402 is described herein in some instances as including a seam, the support stitch line 402 may not be a seam or a stitch. Instead, the support stitch line 402 can include a support element, such as a tape or other attachment that can fuse, bond, adhere, or otherwise attach to the front pouch 106 of the lower torso garment 400, between fabric layers of the front pouch 106, or otherwise connect to the front pouch. For example, the support stitch line 402 can include a stitch-sew line extending laterally across the front pouch 106, taping that is fused, adhered, or otherwise attached to the front pouch, other material that is fused or bonded to the fabric of the front pouch 106, sew thread that is knit, woven, stitched, or otherwise connected to the front pouch, and/or other materials. In some examples, the support stitch line 402 includes a width of up to an inch (e.g., ¼ inches, ½ inches, ¾ inches, or another width dimension). In some instances, the support stitch line 402 can provide some degree of stretch. In some examples, the support stitch line 402 has less stretch than the fabric of the front pouch 106, for example, to provide strength and/or support to the front pouch in addition to or in lieu of a gusset.

In some instances, the horizontal support stitch line 402 and adjacent portions of the left lateral side seam 112*a* and right lateral side seam 112*b* of the front pouch 106 (e.g., portions of the left and right seams extending upward from the horizontal seam) can include elastic elements 408 stitched, tacked, bonded, fused, or otherwise integrated into the seams 112*a* and 112*b*. The elastic elements 408 can extend to a portion of the length of the side seams 112*a* and 112*b*, for example, ¼ of the length, ⅓ of the length, or another portion of the length of the side seams 112*a* and 112*b* beginning at the intersection of the support stitch line 402 and the respective lateral side seams 112*a* and 112*b* of the front pouch 106. In some examples, the generally vertical elastic elements 408 extend along the sew line of the seams 112*a* and 112*b*, while the elastic element 406 of the horizontal support stitch line 402 extends across the fabric of the front pouch 106. In some implementations, the elastic element 406 and/or the elastic elements 408 are stitched when in a stretched state and where the adjacent fabric is in a relaxed (e.g., un-stretched state), and where returning the elastic element(s) to its un-stretched state creates the fabric gathers 404 about the horizontal support stitch 402 and/or the adjacent portions of the left lateral side seam 112*a* and right lateral side seam 112*b* of the front pouch 106. The elastic elements and the fabric gathers 404 provide for a volume (e.g., increased volume) of the sling region while maintaining, increasing, or otherwise affecting the support of the front portion at the horizontal seam and/or at other seam areas. The elastic element 406 and/or the elastic elements 408 can take a variety of forms. For example, an elastic element can include a strip or band of elastomeric material, an elastomeric thread, a stretchy sew tape, or other elements with a degree of stretch greater than the degree of stretch of the fabric of the front pouch 106. Although the support stitch line 402 is described herein in some instances may include a seam, the support stitch line 402 may not be a seam or a stitch. Instead, the support stitch line 402 can include a support element, such as a tape or other attachment that can fuse, bond, adhere, or otherwise attach to the front portion 106 of the lower torso garment 400.

In some instances, the gathered horizontal stitch line or seam is constructed by determining the correct placement of the gathered stitch line or seam on the lower torso garment, which is done by fitting on a fit model and analyzing original garment specs of the boxer brief in which the stitch line or seam is to be added. Once placement is determined, elastic can be added to the inside of garment at bottom of pouch while stretching the elastic during sewing to create gathers in the fabric. The SPI (stitches per inch) can include an SPI of 13, but can vary, for example, between 5 and 20. The gathering stitches work best (e.g., supports best) when sewn through both layers of the pouch fabric.

A gathered support pouch creates support for the wearer of the lower torso garment. A conventional way to add support on this type of garment is by adding a gusset. A gusset can include a piece of fabric, generally in a rectangle or diamond shape, inserted in a garment to allow for more space and greater ease of movement. In men's underwear, for example, the gusset appears along the inseams and crotch area of garment. Although a conventional gusset does provide support, it may not provide any additional shaping to a front pouch, whereas a gathered pouch does provide an increase in support and comfort for the wearer.

In a first aspect, a lower torso garment comprises a body portion, a front pouch disposed about a front region of the body portion, and a support sling connected to the front pouch comprising a left fabric panel extending along a left side periphery of the front pouch, and a right fabric panel extending along a right side periphery of the front pouch, wherein a first portion of the left fabric panel overlaps a first portion of the right fabric panel at an overlap area, the overlap area positioned adjacent to a bottom of the front pouch.

In a second aspect, according to the first aspect, the left fabric panel and the right fabric panel are symmetrical about a centerline of the front pouch.

In a third aspect, according to the first or second aspect, a first long edge of the left fabric panel extends along a left lateral seam connecting the front pouch to adjacent fabric of the body portion, and a first long edge of the right fabric panel extends along a right lateral seam connecting the front pouch to adjacent fabric of the body portion.

In a fourth aspect, according to any of the first aspect through the third aspect, a width of the left fabric panel extends inwardly toward the centerline of the front pouch and over a portion of the front pouch, and a width of the right fabric panel extends inwardly toward the centerline of the front pouch and over a second portion of the front pouch.

In a fifth aspect, according to any of the first aspect through the fourth aspect, the left fabric panel and right fabric panel are substantially planar along their respective lengths between the bottom of the front pouch and a top of the front pouch.

In a sixth aspect, according to any of the first aspect through the fifth aspect, a second portion of the left fabric panel overlaps a second portion of the right fabric panel at a second overlap area, the second overlap area positioned adjacent to a top of the front pouch.

In a seventh aspect, according to any of the first aspect through the third aspect, the left fabric panel criss-crosses along its length between the bottom of the front pouch and a top left section of the front pouch, and the right fabric panel criss-crosses along its length between the bottom of the front pouch and a top right section of the front pouch.

In an eighth aspect, according to any of the first aspect through the seventh aspect, a space between the left fabric panel and the right fabric panel defines an opening configured to receive at least part of an external male genitalia of a wearer of the lower torso garment, where the left fabric panel and the right fabric panel reside between at least part of the external male genitalia and inner thighs of the wearer of the lower torso garment when worn by the wearer.

In a ninth aspect, according to any of the first aspect through the eighth aspect, the left fabric panel and the right fabric panel comprises a mesh fabric.

In a tenth aspect, according to the ninth aspect, the left fabric panel and the right fabric panel comprises a dual-layer mesh fabric.

In an eleventh aspect, according to any of the first aspect through the tenth aspect, an exposed edge of the left fabric panel comprises at least one of a purl stitch, an over-edge stitch, a finished edge, a laser-cut edge, a finished seam, or a folded seam.

In a twelfth aspect, according to any of the first aspect through the eleventh aspect, the lower torso garment further comprises a waistband attached to a top end of the body portion and configured to encircle a torso of a wearer.

In a thirteenth aspect, according to any of the first aspect through the twelfth aspect, the lower torso garment further comprises a gusset attached to a bottom of the body region between two leg portions of the body region.

In a fourteenth aspect, according to any of the first aspect through the thirteenth aspect, the lower torso garment comprises an undergarment.

In a fifteenth aspect, according to the fourteenth aspect, the undergarment comprises one of a boxer, a brief, or a boxer-brief.

A number of implementations have been described. Nevertheless, it will be understood that various modifications may be made without departing from the spirit and scope of the disclosure.

What is claimed is:

1. A lower torso garment comprising:

a body portion;

a left leg portion comprising a first leg opening at a lower longitudinal end of the left leg portion, and a right leg portion comprising a second leg opening at a lower longitudinal end of the right leg portion;

a front pouch disposed about a front region of the body portion;

a gusset positioned at a bottom of the body portion between the two leg portions of the body portion, the gusset connected to the front pouch with a bottom horizontal seam at a bottom of the front pouch; and a support sling connected to the front pouch, the support sling comprising:

a left fabric panel comprising a first laterally outside edge extending along a left side periphery of the front pouch and comprising a first inner edge connected to and extending from the bottom horizontal seam toward a top of the front pouch; and a right fabric panel comprising a second laterally outside edge extending along a right side periphery of the front pouch and comprising a second inner edge connected to and extending from the bottom horizontal seam toward the top of the front pouch;

wherein a first portion of the left fabric panel overlaps a first portion of the right fabric panel at an overlap area, the overlap area positioned adjacent to the bottom horizontal seam at the bottom of the front pouch and the bottom horizontal seam is entirely above the first leg opening and the second leg opening.

2. The lower torso garment of claim 1, wherein the left fabric panel and the right fabric panel are symmetrical about a centerline of the front pouch.

3. The lower torso garment of claim 1, wherein the first laterally outside edge of the left fabric panel extends along a left lateral seam connecting the front pouch to adjacent fabric of the body portion, and the second laterally outside edge of the right fabric panel extends along a right lateral seam connecting the front pouch to adjacent fabric of the body portion.

4. The lower torso garment of claim 3, wherein a width of the left fabric panel extends inwardly toward the centerline of the front pouch and over a portion of the front pouch, and a width of the right fabric panel extends inwardly toward the centerline of the front pouch and over a second portion of the front pouch.

5. The lower torso garment of claim 4, wherein the left fabric panel and right fabric panel are substantially planar along their respective lengths between the bottom of the front pouch and the top of the front pouch.

6. The lower torso garment of claim 5, wherein a second portion of the left fabric panel overlaps a second portion of the right fabric panel at a second overlap area, the second overlap area positioned adjacent to the top of the front pouch.

7. The lower torso garment of claim 1, wherein the left fabric panel twists along its length between the bottom of the front pouch and a top left section of the front pouch such that a top edge of the left fabric panel extends outwardly from the left side periphery of the front pouch and a bottom edge of the left fabric panel extends inwardly from the left side periphery, and the right fabric panel twists along its length between the bottom of the front pouch and a top right section of the front pouch such that a top edge of the right fabric panel extends outwardly from the right side periphery of the front pouch and a bottom edge of the right fabric panel extends inwardly from the right side periphery.

8. The lower torso garment of claim 7, wherein a space between the left fabric panel and the right fabric panel defines an opening configured to receive at least part of an external male genitalia of a wearer of the lower torso garment, where the left fabric panel and the right fabric panel are configured to reside between at least part of the external male genitalia and inner thighs of the wearer of the lower torso garment when worn by the wearer.

9. The lower torso garment of claim 8, wherein the left fabric panel and the right fabric panel comprise mesh fabric.

10. The lower torso garment of claim 9, wherein the left fabric panel and the right fabric panel comprises a dual-layer mesh fabric.

11. The lower torso garment of claim 1, wherein the first inner edge is an exposed edge of the left fabric panel and comprises at least one of a purl stitch, an over-edge stitch, a finished edge, a laser-cut edge, a finished seam, or a folded seam.

12. The lower torso garment of claim 1, further comprising a waistband attached to a top end of the body portion and configured to encircle a torso of a wearer.

13. The lower torso garment of claim 1, wherein the lower torso garment comprises an undergarment.

14. The lower torso garment of claim 13, wherein the undergarment comprises one of a boxer, a brief, or a boxer-brief.

15. The lower torso garment of claim 1, wherein a width of the left fabric panel extends inwardly toward the centerline of the front pouch and over a portion of the front pouch, and a width of the right fabric panel extends inwardly toward the centerline of the front pouch and over a second portion of the front pouch.

16. The lower torso garment of claim 1, wherein the left fabric panel and right fabric panel are substantially planar along their respective lengths between the bottom of the front pouch and the top of the front pouch.

17. The lower torso garment of claim 1, wherein a second portion of the left fabric panel overlaps a second portion of the right fabric panel at a second overlap area, the second overlap area positioned adjacent to the top of the front pouch.

18. The lower torso garment of claim 3, wherein the left fabric panel twists along its length between the bottom of the front pouch and a top left section of the front pouch such that a top edge of the left fabric panel extends outwardly from the left side periphery of the front pouch and a bottom edge of the left fabric panel extends inwardly from the left side periphery, and the right fabric panel twists along its length between the bottom of the front pouch and a top right section of the front pouch such that a top edge of the right fabric panel extends outwardly from the right side periphery of the front pouch and a bottom edge of the right fabric panel extends inwardly from the right side periphery.

19. The lower torso garment of claim 3, wherein the first inner edge is an exposed edge of the left fabric panel comprises at least one of a purl stitch, an over-edge stitch, a finished edge, a laser-cut edge, a finished seam, or a folded seam.

20. The lower torso garment of claim 1, wherein, at the overlap area adjacent to the bottom horizontal seam, a bottom edge of the first portion of the left fabric panel only partially overlaps a bottom edge of the first portion of the right fabric panel.

* * * * *